United States Patent [19]

Green et al.

[11] 4,044,587

[45] Aug. 30, 1977

[54] FORMING OF MATERIALS BY EXTRUSION

[75] Inventors: Derek Green, Cumbria; John Alan Pardoe, Lytham St. Annes; Clifford Etherington, Blackpool, all of England

[73] Assignee: United Kingdom Atomic Energy Authority, London, England

[21] Appl. No.: 570,753

[22] Filed: Apr. 23, 1975

[30] Foreign Application Priority Data

May 7, 1974 United Kingdom ..... 20120/74
Oct. 24, 1974 United Kingdom ..... 46035/74

[51] Int. Cl.[2] ..... B21C 23/01; B21C 33/00

[52] U.S. Cl. ..... 72/261; 72/262; 72/271; 425/374

[58] Field of Search ..... 72/262, 270, 263, 92, 72/93, 41, 206, 64, 65, 231, 233, 13, 27, 46, 256, 272, 253, 271; 425/224, 376, 113, 392, DIG. 16, 374; 264/176 R, 176 F

[56] References Cited

U.S. PATENT DOCUMENTS

| | | | |
|---|---|---|---|
| 2,892,212 | 6/1959 | Rhodes | 425/374 X |
| 3,142,091 | 7/1964 | Curtiss | 425/374 X |
| 3,765,216 | 10/1973 | Green | 72/263 |
| 3,871,810 | 3/1975 | Geyer | 425/374 |
| 3,872,703 | 3/1975 | Green | 72/273 X |
| 3,934,446 | 1/1976 | Avitur | 72/262 X |

*Primary Examiner*—C.W. Lanham
*Assistant Examiner*—D. M. Gurley
*Attorney, Agent, or Firm*—Larson, Taylor and Hinds

[57] ABSTRACT

In the extrusion of a material, which can be a metal feedstock, through a die means by maintaining frictional engagement of the material with passageway defining surfaces of a member which is moved towards the die means such that frictional drag of the passageway defining surfaces urges the material through the die means, the improvement of providing a change in cross-sectional area and/or shape of the passageway along its length in the direction of movement of the material for extruding to a product having a cross-sectional dimension larger than any cross-sectional dimension of the feed by changing the passageway such that at least one cross-sectional dimension of the passageway at the die end thereof is greater than the corresponding dimension at the inlet end thereof, or, for facilitating multiple extrusion at positions spaced apart in the lengthwise direction of the passageway at the extrusion die end thereof, by changing the passageway such that the cross-sectional area of the passageway diminishes in progressing from one extrusion position to the next, to ensure that the speed of extrusion is substantially the same at each position.

6 Claims, 5 Drawing Figures

FORMING OF MATERIALS BY EXTRUSION

BACKGROUND OF THE INVENTION

The present invention relates to the forming of materials by extrusion.

It is known to extrude a material, which material can be a metal feedstock, through a die means by maintaining frictional engagement of the material with passageway defining surfaces of a member which is moved towards the die means such that frictional drag of the passageway defining surfaces urges the material through the die means.

SUMMARY OF THE INVENTION

According to the present invention, there is provided an extrusion process in which a feed of metallic material to be extruded is engaged frictionally by a driving surface which in conjunction with a non-driving surface also engaged with the feed defines a passageway having an inlet end and an extrusion die end, the driving surface having a feed engaging area which is greater than that of the non-driving surface over at least a sufficient length of the passageway for the requisite extrusion pressure to be developed in the feed by a frictional drag effect, incorporating an improvement for extruding to a product having a cross-sectional dimension larger than any cross-sectional dimension of the feed, characterized in that the cross-sectional area of the passageway is changed along its length in the direction from the inlet end of the passageway to the extrusion die end of the passageway in a manner such that at least one cross-sectional dimension of the passageway at the die end thereof is greater than the corresponding dimension at the inlet end thereof, and such that shape deformation of the feed occurs during the passage of the feed along the passageway. An extrusion apparatus is characterized by the improvement in that the cross-sectional area of the passageway is changed along its length in the direction from the inlet end of the passageway to the extrusion die end of the passageway in a manner such that the cross-sectional area of the passageway at the die end thereof is greater than at the inlet end thereof, and such that shape deformation of the feed occurs during the passage of the feed along the passageway.

Also in accordance with the invention in an extrusion process of the previously mentioned type, an improvement is provided for facilitating multiple extrusion characterized in that extrusion occurs at positions spaced apart in the lengthwise direction of the passageway at the extrusion die end thereof, in that the cross-sectional area of the passageway is changed along its length in the direction from the inlet end of the passageway to the extrusion die end of the passageway in a manner such that the cross-sectional area of the passageway is less at the die end than at the inlet end, and in that the cross-sectional area of the passageway diminishes in progressing from one extrusion position to the next, for ensuring that the speed of extrusion is substantially the same at each position. The invention also provides an improved apparatus for practicing such a process.

DESCRIPTION OF THE DRAWINGS

The invention will be described further, by way of example, with reference to the accompanying drawings, in which.

DESCRIPTION OF THE PREFERRED EMBODIMENTS

Figure 1:
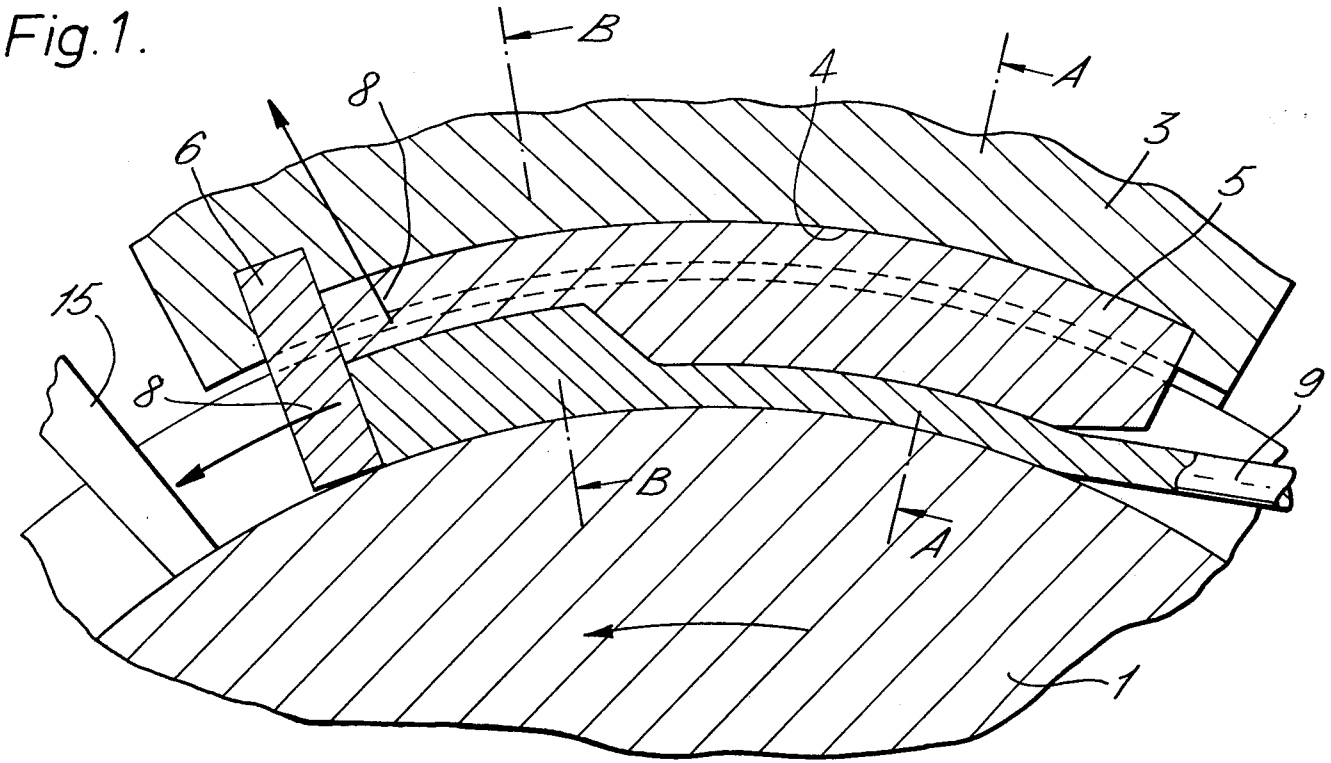
FIG. 1 is a diagrammatic view in medial section of a portion of one embodiment of extrusion apparatus in accordance with the invention.

The embodiment of extrusion apparatus which is shown in FIGS. 1–4 comprises a movable member in the form of a wheel 1 secured for rotation to a drive shaft (not shown). The direction of rotation is anticlockwise. The wheel 1 is formed with a continuous peripheral groove 2 which in the illustrated embodiment is of substantially Y-shaped cross-section. A fixed member in the form of a shoe 3 is arranged about a portion of the periphery of the wheel 1. The shoe 3 can be mounted so as to be adjustable relative to the wheel. The face of the shoe 3 facing the wheel 1 is formed with a groove 4 to receive a removable insert 5, the insert 5 being such as to project into the groove 2 in the wheel 1. Means can be provided for releasably securing the insert in the groove 4 and for adjusting the position of the insert relative to the groove 2 in the wheel. The insert can terminate at one end in an abutment 6 shaped and dimensioned to block the groove in the wheel 1. Alternatively a separate abutment can be provided which is supported by the shoe 3. In this embodiment, the sides and base of the groove 2 provide the driving surface, and the surface of the insert opposing the base of the groove constitutes the non-driving surface.

Figure 2:
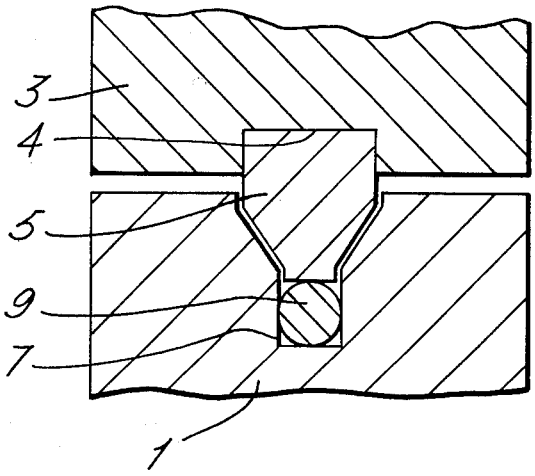
FIG. 2 is a section on line A—A of FIG. 1.
Figure 3:
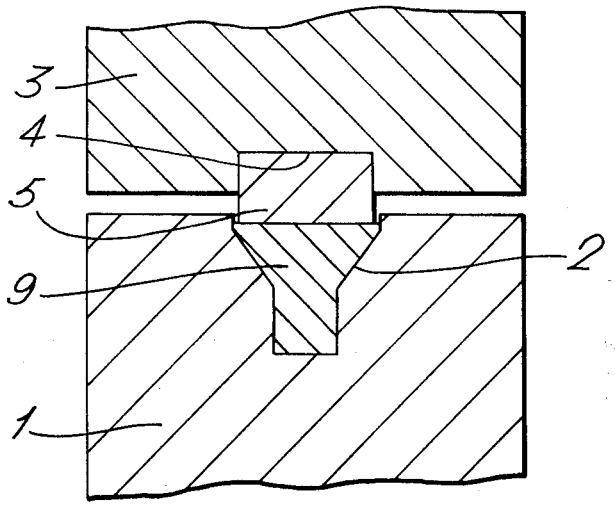
FIG. 3 is a section on line B—B of FIG. 1.
Figure 4:
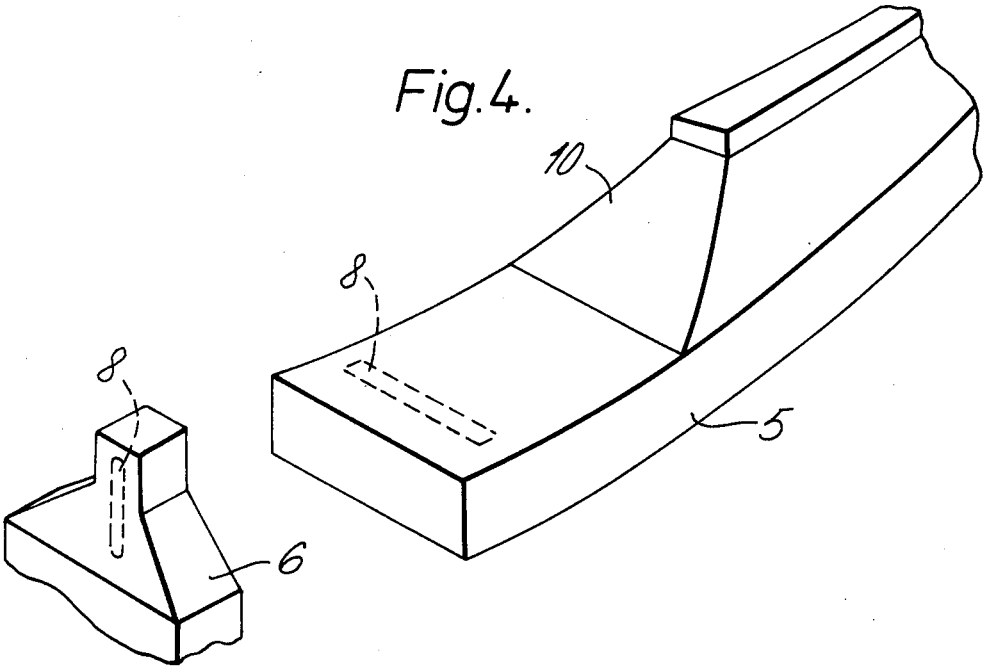
FIG. 4 is an enlarged inverted perspective view of an insert member and a co-operating abutment member.

As seen from FIGS. 2, 3 and 4, the insert 5 is profiled so as to provide a cross-sectional change in the passageway formed between the shoe and the wheel. Over an initial length of this passageway, which can be termed a primary grip length, the insert 5 is shaped and dimensioned to extend into the base or leg portion 7 of the Y-shaped groove in the wheel. This is seen from FIG. 2 which is a section through the so-called primary grip length. However over a length of the passageway immediately in front of the abutment 6 the insert 5 is such as to close the mouth of the groove 2 in the wheel without extending deeply into the groove. This length of the passageway can be termed the secondary or extrusion grip length. One or more extrusion dies (two, which may or may not be alternatives, are shown in FIGS. 1 and 4 at spaced positions designated 8) is or are arranged at the end of the secondary grip length in the vicinity of the abutment. The die can be situated in the insert and shoe so that the extrusion product is emitted in a substantially radial direction and/or the die can be arranged in the end abutment 6 so that extrusion is substantially tangential of the wheel 1. In FIG. 1 the alternate or additional die positions are indicated diagrammatically by the arrow, whereas in FIG. 4 the die positions are shown in dotted outline.

It will be seen from FIGS. 2 and 3 that the passageway changes from a rectangular, conveniently square, cross-section over the primary grip length to a substantially Y-shaped section over the secondary grip length. Over the primary grip length the insert 5 urges a feedstock 9, in the present example a metal rod of circular cross-section but which can include a powder feed, with or without precompaction, into frictional engagement with the driving surfaces formed by the sides of the groove in the wheel. Over this primary grip length the stationary surface of the insert engaging the feedstock can be shaped or otherwise provided in order to reduce or limit the engagement with the feedstock and thereby reduce the resistance to forward movement of the feedstock.

At a region where axial yield of the feedstock takes place the profile of the insert 5 is modified over a length 10 as shown in FIG. 4 to enable the feedstock to flow into the larger cross-section of the passageway forming the secondary grip length. From this length of the passageway extrusion occurs through the die orifice or orifices arranged adjacent or in the abutment.

Figure 5:
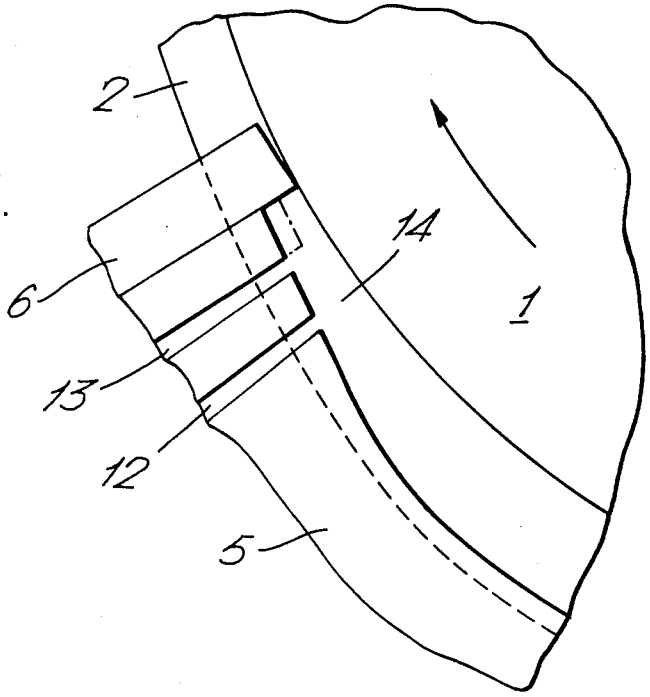
FIG. 5 is a diagrammatic representation of a portion of another embodiment of extrusion apparatus according to the invention.

It will be noted that in the example illustrated which is not limitative the shape and cross-section of the extruded product is completely different from that of the feedstock. In this example, a round section feedstock has been extruded into a strip or sheet form. It is preferable although not essential to adapt the shape and cross-section of the passageway formed between the driven wheel 1 and the stationary shoe 3 to the shape and disposition of the die orifice or orifices. Thus in a terminal part of the passageway, changes of cross-sectional area can be made for adjusting the feed of material now compressed to the extrusion pressure to the shape and disposition of the die orifice or orifices through which the extruded product is to be formed. An example of this is illustrated in FIG. 5 which shows the passageway terminating in two axially spaced die orifices 12 and 13 located at different positions. With a terminal length of passageway having a uniform cross-section there would be the tendency for extrusion to proceed faster at the leading die orifice 12. This can be avoided by progressively decreasing the cross-sectional area of the passageway over the region 14. Such an arrangement of progressive diminution of the passageway area is likewise advantageous for the extrusion of strip or sheet in which the extrusion orifice length is arranged in the same direction as the passageway. However in the case of separate orifices, such as wire extruding orifices, it is possible to incorporate, as shown in dot-and-dash lines in FIG. 5, a stepwise diminution of the passageway between separate orifices.

During extrusion of some materials, an example being aluminium, there is a tendency for residual metal to build-up as an adherent layer on the surfaces of the groove in the wheel or driven member. If allowed to accummulate, this layer will cause a gradual contraction of the passageway as operation continues. This buildup can also cause displacement of the abutment member 6. Further this layer will be warm as a result of the extrusion pressure and prone to oxidation as it is carried around by the wheel. This can contaminate fresh feedstock being introduced into the passageway.

It can therefore be advantageous in such cases to provide cleaning means, such as a scraper blade or blades, one being illustrated in FIG. 1 designated 15, to engage the walls of the groove in the wheel in order to remove and prevent the build-up of such a layer. The scraper blades or blades can be positioned at any convenient location about the periphery of the wheel. As alternatives (not shown) to scraper blades there can be employed rotating cutter discs, fixed or rotating brushes, or the like.

With materials which are not inherently adherent (examples being copper and steel), any material which passes the abutment 6 without being extruded through the die or dies can be removed from the groove in the wheel as flash.

It will be appreciated that the fit of the shoe member relative to the groove will determine the amount of flash formation and that in this context the positioning of the abutment closing off the high pressure end of the passageway must be considered as well. Not only is it necessary in practice that the shoe member should be retractable from the groove but also it is preferred for flash control that fine adjustment can be made relative to the groove of both the shoe member and the abutment, the one independently to the other. The shoe member may have the abutment mounted adjustably thereon and is then mounted itself to be movable into and out of the operating relationship with the groove, a movement which may be linear or, in the case of a circumferential groove, pivotal about the end of the shoe member remote from the abutment.

We claim:

1. In an extrusion process in which a feed of metallic material to be extruded is engaged frictionally by a driving surface which in conjunction with a non-driving surface also engaged with the feed defines a passageway having an inlet end and an extrusion die end, the driving surface having a feed-engaging area which is greater than that of the non-driving surface over at least a sufficient length of the passageway for the requisite extrusion pressure to be developed in the feed by a frictional drag effect, the improvement for extruding to a product having a cross-sectional dimension larger than any cross-sectional dimension of the feed, characterized in that the cross-sectional area of the passageway is changed along its length in the direction from the inlet end of the passageway to the extrusion die end of the passageway in a manner such that at least one cross-sectional dimension of the passageway at the die end thereof is greater than the corresponding dimension at the inlet end thereof, and such that shape deformation of the feed occurs during the passage of the feed along the passageway.

2. In an extrusion process in which a feed of metallic material to be extruded is engaged frictionally by a driving surface which in conjunction with a non-driving surface also engaged with the feed defines a passageway having an inlet end and an extrusion die end, the driving surface having a feed-engaging area which is greter than that of the non-driving surface over at least a sufficient length of the passageway for the requisite extrusion pressure to be developed in the feed by a frictional drag effect, the improvement for facilitating multiple extrusion characterized in that extrusion occurs at positions spaced apart in the lengthwise direction of the passageway at the extrusion die end thereof, in that the cross-sectional area of the passageway is changed along its length in the direction from the inlet end of the passageway to the extrusion die end of the passageway in a manner such that the cross-sectional area of the passageway is less at the die end than at the inlet end, and in that the cross-sectional area of the passageway diminishes in progressing from one extrusion position to the next, for ensuring that the speed of extrusion is substantially the same at each position.

3. In extrusion apparatus having first and second members defining a passageway therebetween to receive material to be extruded, said passageway having an inlet end and an extrusion end, the first and second members being movable relative to one another in the plane of the passageway so that they cooperate to define said passageway, an abutment member fixed relative to one member to project into and block said passageway at the extrusion end, and means defining at least one die orifice in said extrusion end of the passageway, the improvement for extruding to a product having a cross-sectional dimension larger than any cross-sectional dimension of the feed, characterized in that the cross-sectional area of the passageway is changed along its length in the direction from the inlet end of the passageway to the extrusion die end of the passageway in a manner such that the cross-sectional area of the passageway at the die end thereof is greater than that at the inlet end thereof, and such that shape deformation of the feed occurs during the passage of the feed along the passageway.

4. Apparatus as claimed in claim 3 wherein the other member has a groove into which the one member extends for defining the passageway, and wherein the groove shape, in cross-section, widens toward the said one member, the amount by which the said one member extends into the groove being less at the extrustion die end than at the inlet end, whereby as a result of the widening of the groove shape, the material immediately prior to extrusion has a cross-sectional dimension in one direction exceeding any cross-sectional dimension of the material at entry to the passageway.

5. Extrusion apparatus as claimed in claim 4 wherein one cross-sectional dimension of the die orifice approximates said cross-sectional dimension of the material immediately prior to extrusion and is greater than any cross-sectional dimension of the material at entry to the passageway.

6. In extrusion apparatus having first and second members defining a passageway therebetween to receive material to be extruded, said passageway having an inlet end and and extrusion end, the first and second members being movable relative to one another in the plane of the passageway so that they cooperate to define said passageway, an abutment member fixed relative to one member to project into and block said passageway at the extrusion end, means defining at least one die orifice in said extrusion end of the passageway, the improvement for facilitating multiple extrusion characterized in that extrusion occurs at positions spaced apart in the lengthwise direction of the passageway at the extrusion die end thereof in that the cross-sectional area of the passageway is changed along its length in the direction from the inlet end of the passageway to the extrusion die end of the passageway in a manner such that the cross-sectional area of the passageway is less at the die end than at the inlet end, and in that the cross-sectional area of the passageway diminishes in progressing from one extrusion position to the next, for ensuring that the speed of extrusion is substantially the same at each position.

* * * * *